United States Patent [19]

Rhodes et al.

[11] Patent Number: 4,544,901

[45] Date of Patent: Oct. 1, 1985

[54] MICROWAVE FILTER STRUCTURE

[75] Inventors: John D. Rhodes, Guiseley, United Kingdom; Richard J. Cameron, Noordwijk, Netherlands

[73] Assignee: Agence Spatiale Europeenne, Paris, France

[21] Appl. No.: 571,556

[22] PCT Filed: Jun. 11, 1982

[86] PCT No.: PCT/BE82/00015

§ 371 Date: Dec. 29, 1983

§ 102(e) Date: Dec. 29, 1983

[87] PCT Pub. No.: WO83/04457

PCT Pub. Date: Dec. 22, 1983

[51] Int. Cl.[4] ..... H01P 1/208; H01P 7/06

[52] U.S. Cl. ..... 333/212; 333/208; 333/230; 333/232

[58] Field of Search ..... 333/202, 208–212, 333/228–235

[56] References Cited

U.S. PATENT DOCUMENTS

| | | | |
|---|---|---|---|
| 2,541,375 | 2/1951 | Mumford | 333/208 |
| 2,738,469 | 3/1956 | Miller | 333/208 |
| 2,968,771 | 1/1961 | De Loach, Jr. | 333/209 |
| 3,235,822 | 2/1966 | De Loach, Jr. | 333/212 |
| 3,697,898 | 10/1972 | Blachier et al. | 333/209 |
| 4,028,651 | 6/1977 | Leetmaa | 333/212 |
| 4,030,051 | 6/1977 | Shimizu et al. | 333/227 |

FOREIGN PATENT DOCUMENTS

| | | |
|---|---|---|
| 2557809 | 6/1977 | Fed. Rep. of Germany . |
| 1151803 | 2/1958 | France . |
| 2100640 | 3/1972 | France . |

*Primary Examiner*—Marvin L. Nussbaum
*Attorney, Agent, or Firm*—Fred A. Keire

[57] ABSTRACT

A structure comprising a cascade of dual mode resonance cavities wherein each cavity has a pair of tuning screws located at 90° to each other in a sectional plane of the cavity and a coupling screw located at 45° to the tuning screws for coupling the two resonances supported by the cavity. Each cavity is coupled to the adjacent cavity by means of a coupling iris set at a determined angle relative to the angular position of the tuning screws of the cavity and the adjacent cavity is positioned at a determined angle relative to the angular position of the coupling iris which couples said cavity to the former one.

3 Claims, 8 Drawing Figures

30.000
25.0
20.0
15.0
10.0
5.00
0.0
14.000
14.05
14.10
14.15
14.20
14.250
MHz 30.000
25.0
20.0
15.0
10.0
5.00
0.0
14.000
14.05
14.10
14.15
14.20
14.250
MHz 20.000
15.0
10.0
5.00
0.0
14.000
14.05
14.10
14.15
14.20
14.250
MHz

MICROWAVE FILTER STRUCTURE

BACKGROUND OF THE INVENTION

The present invention relates to the realization of microwave bandpass filters with dual mode resonance cavities arranged so as to achieve asymmetrical transmission characteristics.

Microwave bandpass filters are widely used in terrestrial and space telecommunications systems in order to provide noise or interference rejection and in multiplexers where they are used for low loss combination or separation of different transmission channels. The majority of these characteristics are symmetric and have been realized in microwave structures that are synchronously tuned, i.e. structures in which all resonators are tuned to the same center frequency.

In some particular applications, however, it is desirable to provide asymmetric transmission characteristics. A first application, for instance is the outer channel filters in a contiguous-channel multiplexer where the absence of a neighbour channel on one side causes a severe asymmetric distortion of the in-band group delay and insertion loss characteristics. This asymmetric distortion can be very damaging to digital signals and, if uncorrected, will require higher transmitter powers to restore the bit error rate to that of the undistorted case. Another major application is within transmission systems which have asymmetric rejection specifications, for example in a receive channel with an adjacent transmit channel which has to be heavily rejected.

Considering the physical implementation an interesting construction uses in-line dual mode resonance cavities. FIG. 1 shows schematically an exploded view of a two-cavity implementation. The two cylindrical cavities 100 and 200 are separated by a plate 300 having a cruciform coupling iris 400 therein. Each cavilty supports two $TE_{11}$ mode resonances, polarized orthogonally to each other and tuned individually by means of a tuning screw. These two resonances are coupled by means of a coupling screw located at 45° to the tuning screws. Coupling between resonances in adjacent cavities is achieved with the cruciform coupling iris 400. This type of construction only realizes transmission characteristics which are symmetric about the center frequency because the starting point is always a folded prototype network which is essentially symmetric (FIG. 2). This is a folded ladder network allowing cross-coupling between non adjacent shunt capacitors. These cross-couplings are designated by the symbols K18, K27, K38. Such a network is in effect the electrical embodiment of the characteristics which are defined in purely mathematical form by transfer polynomials. The process for converting these transfer polynomials to the folded electrical network has been described by J. D. Rhodes in: "A Low-Pass Prototype Network For Microwave Linear Phase Filters (IEEE-MTT, Vol. MTT-18, June 1970, pp. 145–160).

In order to create asymmetric responses it is required to construct a structure corresponding to an electrical prototype network comprising diagonal couplings as shown at K17, K26, K35 in FIG. 3.

SUMMARY OF THE INVENTION

The object of the invention is a microwave filter using dual mode resonance cavities arranged so as to achieve asymmetrical transmission characteristics.

This object is achieved in accordance with the invention by a microwave structure comprising of cascade of dual mode resonance cylindrical cavities wherein each cavity is coupled to the adjacent cavity by a coupling iris set at a determined angle relative to the angular position of the tuning screws of the cavity, with the adjacent cavity set at a determined angle relative to the angular position of the coupling iris between said adjacent cavity and the former cavity.

DESCRIPTION OF AN EXEMPLARY EMBODIMENT

Figure 4:
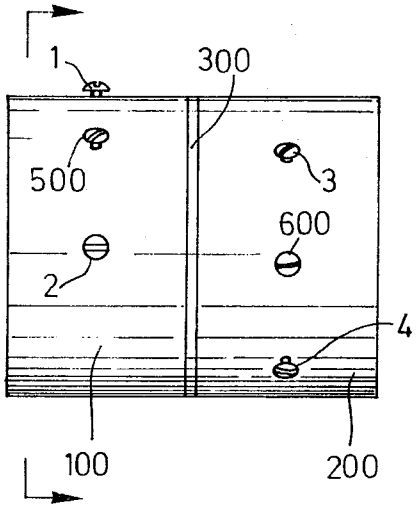
FIG. 4 is an elevational view of an embodiment of the structure according to the invention.

In the following a two-cavity microwave structure will be described by way of example. Referring to FIG. 4, the numerals 100 and 200 designate two cylindrical resonant cavities separated by an iris plate 300 having a cruciform coupling iris 400 formed therein. Each cavity supports two $TE_{11}$ mode resonances polarized orthogonally to each other, with each resonance being tuned individually by means of a tuning screw. For the cavity 100, the tuning screws are denoted 1 and 2. The angular position of these tuning screws will serve as a reference position when organizing the structure.

Figure 1:
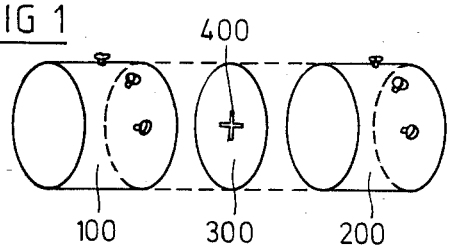
FIG. 1 is an exploded view of a type of construction of microwave filter structure using dual mode resonance cavities.
Figure 2:
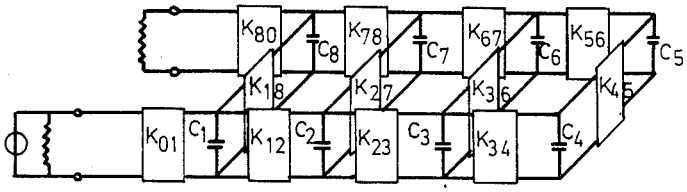
FIG. 2 shows the electrical prototype network corresponding to a type of structure as illustrated in FIG. 1.
Figure 3:
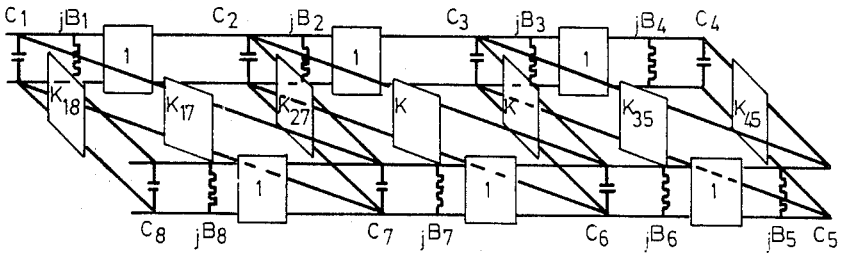
FIG. 3 shows an electrical prototype network which is able to achieve asymmetrical transmission characteristics.
Figure 5:
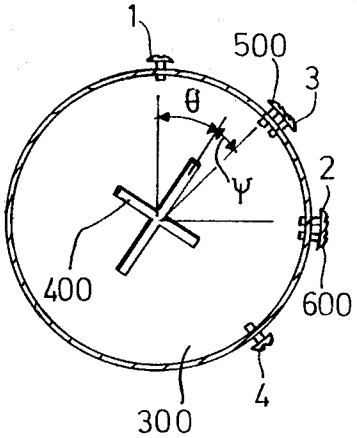
FIG. 5 is a view along line V—V of FIG. 4.

The iris plate 300 (FIG. 5) is positioned such that the coupling iris 400 is set at an angle $\theta$ to the angular position of the tuning screws 1 and 2 of the first cavity 100. The second cavity 200 is positioned such that its tuning screws 3 and 4 are set at an angle $\psi$ to the angular position of the coupling iris 400. The angular position of the tuning screws of the second cavity relative to the tuning screws of the first cavity thus is $\theta+\psi$.

Each cavity supports two independent resonances tuned individually by means of the tuning screws and the coupling between these resonances is adjusted by means of a coupling screw set at 45° to the tuning screws. In the cavity 100, the coupling $M_{12}$ between the resonances 1 and 2 is adjusted by means of coupling screw 500 and in the cavity 200 the coupling $M_{34}$ between the resonances 3 and 4 is adjusted by means of the coupling screw 600.

Designating the couplings achieved by the two arms of iris 400 by $M_1$ and $M_2$, the couplings between the resonances in the two cavities, provided by the iris 400, may be written down:

$$\begin{aligned} M_{13} &= -M_1 \cos\theta \sin\psi - M_2 \sin\theta \cos\psi \\ M_{14} &= M_1 \cos\theta \cos\psi - M_2 \sin\theta \sin\psi \\ M_{23} &= -M_1 \sin\theta \sin\psi + M_2 \cos\theta \cos\psi \\ M_{24} &= M_1 \sin\theta \cos\psi + M_2 \cos\theta \sin\psi \end{aligned} \quad \text{(I)}$$

This set of four equations contains four unknowns $M_1$, $M_2$, $\theta$ and $\psi$. The simultaneous solution for these four unknowns makes it possible te determine all the design parameters necessary to construct a two-cavity structure.

The mathematical procedure resulting in the solution of these equations is disclosed in "General Synthesis Methods For Microwave Filters" by Richard J. Cameron, ESA Journal, Vol. 6, No. 2, 1982.

Cascade structures of higher orders using a greater number of cavities is designed in a similar way.

A simplified embodiment for 4th and 6th degree structures consists in using a simple slot iris instead of a curciform iris. In this case, the equations (I) reduce to the following set:

$$M_{13}=-M_1\cos\theta\sin\psi$$

$$M_{14}=M_1\cos\theta\cos\psi \qquad \text{(II)}$$

$$M_{23}=-M_1\sin\theta\sin\psi$$

$$M_{24}=M_1\sin\theta\sin\psi$$

The procedure for designing a microwave filter structure using dual mode resonance cavities comprises two steps. The first step is, starting from the electrical prototype network corresponding to the desired transfer function. to convert the prototype network into a coupling matrix. The next step in the procedure is to apply similarity transformations to this matrix until only those couplings are present in the matrix that can be realized by a cascade structure of dual mode resonance cavities and their coupling components. This procedure is developed in the following papers: "A Novel Realisation For Microwave Bandpass Filters" by R. J. Cameron, ESA Journal, Vol. 3, No. 4, 1979, pp 281-287 and "Asymmetric Realisation for Dual-Mode Bandpass Filters" by R. J. Cameron and J. D. Rhodes, IEEE Trans. MTT, Vol. MTT-29, No. 1, January 1981, pp. 51-58.

Figure 6:
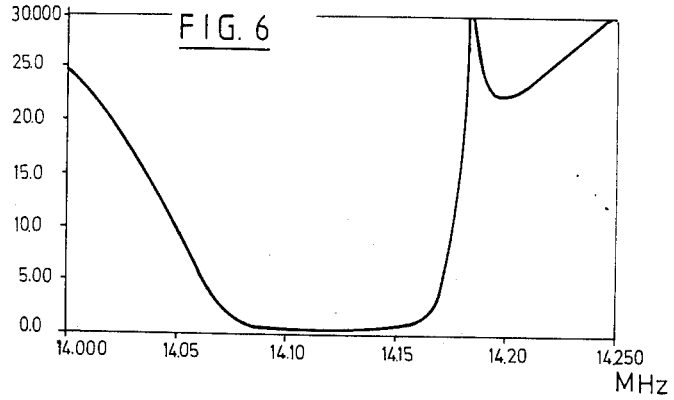
FIGS. 6–8 show transmission characteristics achieved with an exemplary implementation of the structure according to this invention.
Figure 7:
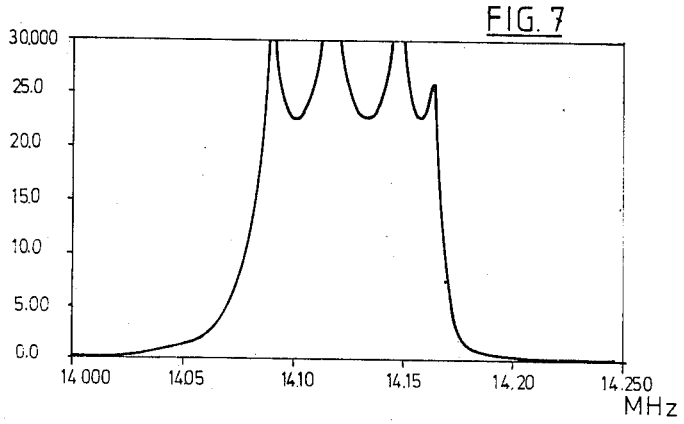
Figure 8:
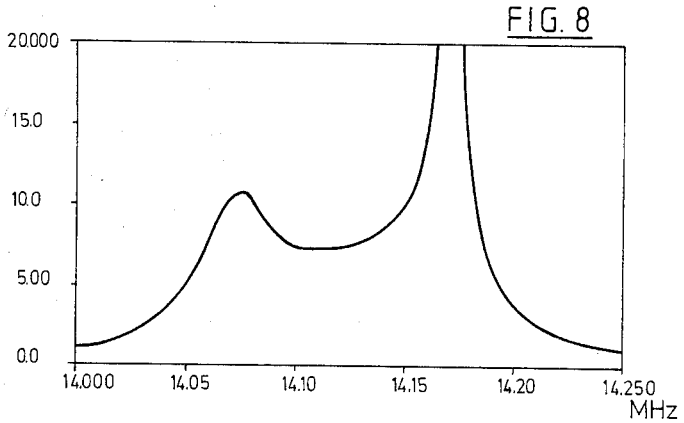

An exemplary 4th degree filter embodiment has been designed using a single slot iris. This filter has a 80 MHz bandwidth with a center frequency of 14125 MHz. The theoretical attenuation, return-loss and group delay characteristics appear in FIGS. 6 to 8.

This filter has been designed based on the prototype coupling matrix of Table 1. Applying the similarity transformation at pivot (2,3), angle $\lambda=35.95°$, results in the new coupling matrix of Table 2.

TABLE 1

| | 1 | 2 | 3 | 4 |
|---|---|---|---|---|
| 1 | 0.0759 | 0.7758 | 0.5627 | 0.0 |
| 2 | 0.7758 | −0.6806 | 0.5580 | 0.0 |
| 3 | 0.5627 | 0.5580 | 0.1288 | 0.9584 |
| 4 | 0.0 | 0.0 | 0.9584 | 0.0759 |

TABLE 2

| | 1 | 2 | 3 | 4 |
|---|---|---|---|---|
| 1 | 0.0759 | 0.9584 | 0.0 | 0.0 |
| 2 | 0.9584 | 0.1288 | 0.5580 | 0.5627 |
| 3 | 0.5627 | 0.5580 | −0.6806 | 0.7758 |
| 4 | 0.0 | 0.0 | 0.7758 | 0.0759 |

Finally, applying and solving the equations (II) results in obtaining the following design parameter values:

$$\theta=90°;\ \psi=-44.76°;\ M_1=0.7925.$$

Physically, the coupling iris between the two cavities is a slot oriented at right angles to the angular position of the tuning screw for resonance 1 and the length of the slot is calculated in the ordinary way to realize the coupling value $M_1=0.7925$. The second cavity is positioned such that the tuning screw for resonance 3 is set at an angle of 44.76° in the anti-clockwise direction relative to the orientation of the coupling slot $M_1$. The input and output coupling slots $M_{01}$ and $M_{40}$ are aligned with the angular positions of the tuning screws for the resonances 1 and 4 respectively: their lengths are calculated in the conventional way from a knowledge of the terminating impedances.

What is claimed is:

1. A microwave filter structure comprising:

a first cylindrical cavity having a pair of tuning screws and a coupling screw, the tuning screws being located approximately 90 degrees from each other, the coupling screw being located approximately 45 degrees from each tuning screw, the first cavity having a first and a second resonance;

a second cylindrical cavity having a pair of tuning screws and a coupling screw, the tuning screws being located approximately 90 degrees from each other, the coupling screw being located approximately 45 degrees from each tuning screw, the second cavity having a third and a fourth resonance;

a coupling iris positioned between the first and second cavities;

wherein the coupling iris is located at an angle theta relative to the tuning screws of the first cavity and the second cavity is located at an angle psi relative to the coupling iris;

wherein the angles theta and psi are determined from the following equations:

$$M_{13}=-M_1\cos(\text{theta})\sin(\text{psi})-M_2\sin(\text{theta})\cos(\text{psi});$$

$$M_{14}=M_1\cos(\text{theta})\cos(\text{psi})-M_2\sin(\text{theta})\sin(\text{psi});$$

$$M_{23}=-M_1\sin(\text{theta})\sin(\text{psi})+M_2\cos(\text{theta})\cos(\text{psi});$$

$$M_{24}=M_1\sin(\text{theta})\cos(\text{psi})+M_2\cos(\text{theta})\sin(\text{psi});$$

and wherein the coefficients $M_1$ and $M_2$ represent the coupling values of the coupling iris, the coefficient $M_{13}$ represents the coupling between the first and third resonances, the coefficient $M_{14}$ represents the coupling between the first and fourth resonances, the coefficient $M_{23}$ represents the coupling between the second and third resonances, and the coefficient $M_{24}$ represents the coupling between the second and fourth resonances.

2. A structure according to claim 1, wherein the coupling iris has a cruciform shape.

3. A structure according to claim 1, wherein the coupling iris is a slot and the coefficient $M_2$ is approximately zero.

* * * * *